United States Patent [19]

Lewin et al.

[11] 4,081,667

[45] Mar. 28, 1978

[54] LIGHTING FIXTURE HAVING FRESNEL REFLECTOR WITH HIGH REFLECTION COATING THEREON

[75] Inventors: Ian Lewin, Scottsdale, Ariz.; Edward S. Small, Jr., Santa Rosa, Calif.

[73] Assignee: Optical Coating Laboratory, Inc., Santa Rosa, Calif.

[21] Appl. No.: 708,859

[22] Filed: Jul. 28, 1976

[51] Int. Cl.[2] ..... F21V 7/09; F21V 7/00

[52] U.S. Cl. ..... 362/296; 362/348

[58] Field of Search ..... 240/51.11 R, 41.37, 240/41.36, 41.35 E, 41.35 A, 41.35 R, 41.35 F, 103 A, 103 B, 103 R, 47

[56] References Cited

U.S. PATENT DOCUMENTS

| | | | |
|---|---|---|---|
| 1,347,268 | 7/1920 | Godley | 240/41.36 |
| 1,427,504 | 8/1922 | Whyte | 240/41.36 |
| 1,558,270 | 10/1925 | Morrison | 240/41.36 |
| 1,570,503 | 1/1926 | Kralicek | 240/41.36 |
| 2,145,732 | 1/1939 | Nickle | 240/103 R UX |
| 2,330,924 | 10/1943 | Rolph | 240/51.11 R X |
| 2,852,980 | 9/1958 | Schroder | 240/47 UX |
| 3,165,265 | 1/1965 | Clause | 240/103 R |
| 3,644,730 | 2/1972 | Ogle et al. | 240/103 R |
| 3,654,451 | 4/1972 | Starr | 240/41.35 R X |

FOREIGN PATENT DOCUMENTS

| | | | |
|---|---|---|---|
| 493,892 | 6/1950 | Belgium | 240/103 R |
| 657,104 | 10/1963 | Italy | 240/103 R |
| 334,891 | 9/1930 | United Kingdom | 240/41.36 |

*Primary Examiner*—Donald A. Griffin

*Attorney, Agent, or Firm*—Flehr, Hohbach, Test, Albritton & Herbert

[57] ABSTRACT

Lighting fixture having housing with an open side. A lamp is mounted in the housing and produces rays which pass through the open side. The housing carries an internal reflecting surface for reflecting light rays from the lamp through the open side. The internal reflecting surface includes Fresnel type portions for reflecting light rays from the lamp at high angles through the open side. In certain applications, the open side would be enclosed by a glass enclosure. In order to increase the efficiency of the lighting fixture, an anti-reflection coating can be provided on both sides of the glass enclosure.

12 Claims, 6 Drawing Figures

LIGHTING FIXTURE HAVING FRESNEL REFLECTOR WITH HIGH REFLECTION COATING THEREON

BACKGROUND OF THE INVENTION

Many different types of lighting fixtures hereto fore have been provided. However in connection with such lighting fixtures there always is a need for increased reflectivity from the reflective portions of the lighting fixture. In addition, there is a further requirement to obtain better control over the direction of the light emitted from the lighting fixture. Therefore there is a need for a new and improved lighting fixture which is more efficient and one which emits more light rays at high angles.

SUMMARY OF THE INVENTION AND OBJECTS

The lighting fixture consists of a housing which has an open side. A lamp is mounted in the housing and produces light rays through the open side of the housing. The housing carries an internal reflecting surface for reflecting light rays from the lamp through the open side. The internal reflecting surface includes Fresnel type portions for reflecting light rays at higher angles through the open side. High reflecting coatings are provided on the Fresnel portions to increase the efficiency of the lighting fixture. In certain applications a glass enclosure is provided to cover the open side of the housing. To also increase the efficiency, anti-reflection coatings are provided on both surfaces of the glass enclosure.

In general, it is an object of the present invention to provide a lighting fixture in which increased efficiency is obtained by increasing the reflectivity from reflective portions of the lighting fixture.

Another object of the invention is to provide a lighting fixture of the above character which is provided with Fresnel type reflecting surfaces for increasing the amount of light which is emitted from the fixture at high angles.

Another object of the invention is to provide a lighting fixture of the above character in which it is possible to direct the rays in any desired direction from the light fixture without depending on the overall surface configuration of the reflecting surface.

Another object of the invention is to provide a lighting fixture of the above character in which the light emitted at high angles directly from the lamp is increased.

Another object of the invention is to provide a lighting fixture of the above character in which it is possible to reduce the profile of the lighting fixture.

Another object of the invention is to provide a lighting fixture of the above character which has an increased coefficient of utilization.

Additional objects and features of the invention will appear from the following description in which the preferred embodiment are set forth in detail in conjunction with the accompanying drawings.

DESCRIPTION OF THE PREFERRED EMBODIMENTS

Figure 1:
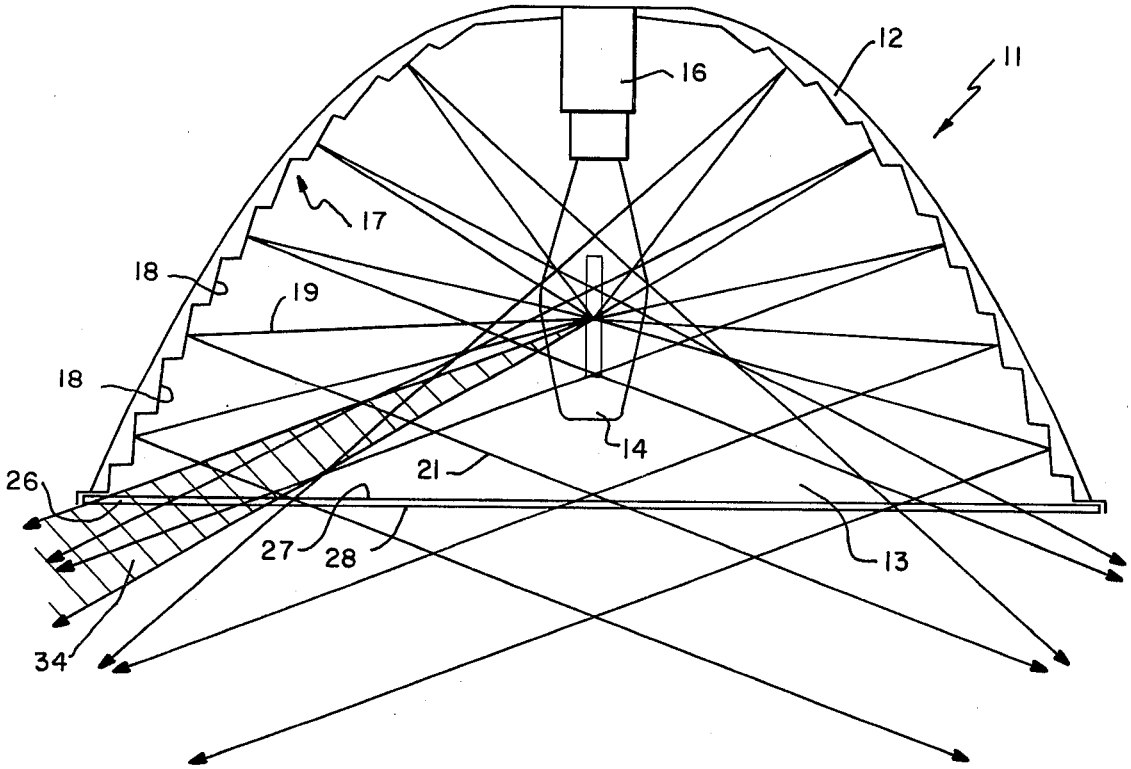
FIG. 1 is a cross-sectional view of a lighting fixture incorporating the present invention.

In FIG. 1 there is disclosed a lighting fixture or luminaire 11 incorporating the present invention. It consists of a housing 12, which also can be called a reflector. It has an open side 13. A light source is provided within the housing for directing rays of light through the open side 13 and consists of a lamp 14 mounted in a socket 16. The socket 16 is mounted in the housing 12 in a conventional manner. The lamp 14 can be of any conventional type. For example, in roadway and parking lot lighting where large areas are to be covered, the lamp 14 conventionally is high-intensity discharge (HID) lamp and typically uses a metal halide or high-pressure sodium light source. Alternatively a mercury arc lamp may be utilized.

The housing 12 has a substantially parabolic configuration as shown. Internal reflecting means is carried by the housing for reflecting light from the lamp 14 out through the open side 13. The reflecting means 17 in FIG. 1 is in the form of a deeply dished reflective surface, which may be parabolic in configuration with the lamp 14 being generally in the center of the parabola. The reflecting surface is formed with a plurality of facets or portions 18. The facets or portions 18 are generally planar and take the form of annular bands, which surround or encircle the lamp 14. The facets or portions 18 serve as a front surface Fresnel type reflector, which is designed to reflect the light rays in the desired direction. The housing 12 as shown in the drawing with its reflective means 17 is formed of a suitable material such as Pyrex, which has a low coefficient of expansion and can withstand high temperatures. In the embodiment shown the facets 18 have been formed integral with the body of the housing 12.

With respect to the reflecting surface 17, the color of the glass or the index of refraction of the glass is unimportant because as hereinafter described the facets 18 would be over-coated with protecting and reflectance enhancing layers as hereinafter described. The facet 18 is positioned in such a manner so that a ray trace from the source of light to the facet and from the facet out of the housing 12 is at the desired angle. Thus each facet is designed so that the rays reflected therefrom will be emitted at the desired angle. In the embodiment shown in FIG. 1, the facets have been designed so that the rays emitted therefrom are at an angle of approximately 70° or greater. The arrows 19 represent the rays from the lamp to the facet and the arrows 21 represent the light rays from the facet and passing through the open side at 13. As shown from the cross-sectional view in FIG. 1, the facets 18, form steps in the interior of the housing 12.

It will be noted, however, with respect to the facets near the top of the housing 12 that the angle has been reduced somewhat in order to prevent the rays reflected therefrom from striking the housing 12. For that reason the angles are decreased slightly so that the rays reflected from the facets will clear the lower extremities of the housing 12. It should be appreciated that the fixture shown in FIG. 1 can be utilized with its bottom side open. However, in many applications it may be desirable to close the open side. For this purpose, a glass enclosure 26 has been provided which has inside and outside planar parallel surfaces 27 and 28. An anti-reflection coating (not shown) would be provided on both of the surfaces 27 and 28. Suitable anti-reflection coatings for this purpose are disclosed in co-pending application Ser. No. 709,413, filed July 28, 1976.

The shaded area 34 shown in FIG. 1 represents the additional light which can be obtained from the fixture directly from the lamp at high angles which would not be obtained with the fixture of a smaller diameter. This is important because this is the reason why increased light is desired. By increasing the quantity of high angle light and by making the fixture more efficient, it is possible to utilize fewer fixtures, thus justifying a larger diameter fixture.

Figure 2:
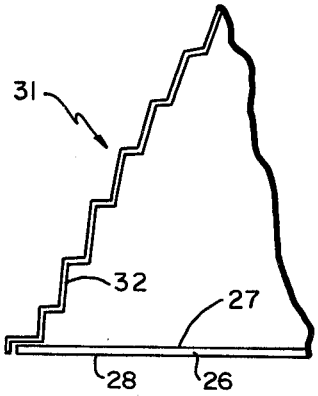
FIG. 2 is a partial cross-sectional view showing an alternative construction to that shown in FIG. 1.

In FIG. 2 there is shown an alternative version of the lighting fixture shown in FIG. 1 with the only difference being that housing 31, which corresponds to housing 12 instead of being formed of a material such as Pyrex is formed to provide facets 32, which correspond to the facets 18 in the housing 12. In this way it can be seen that a relatively inexpensive housing can be provided incorporating the present invention.

Figure 3:
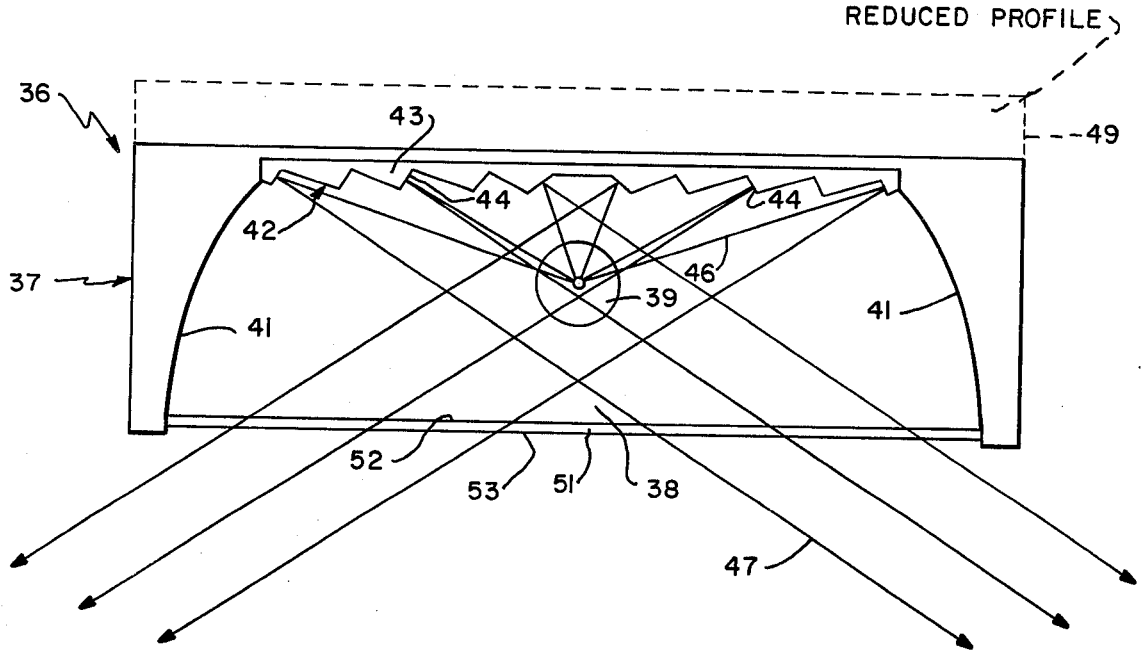
FIG. 3 is a cross-sectional view of another embodiment of a lighting fixture incorporating the present invention.

In FIG. 3 there is shown a cross-sectional view of a lighting fixture or luminaire 36, incorporating the present invention which is a modified sharp cut-off type lighting fixture or luminaire. The fixture is provided with a housing, which is generally box-shaped in configuration and has an open side 38. A source of light is provided within the housing 37 for emitting rays downward through the open end 38 of the housing. The source of light is in the form of a lamp 39, which has its axis extending parallel to the bottom plane of the side opening 38. The lamp 39 is mounted in a socket (not shown) carried by the housing. Reflective means is carried by the housing for reflecting light rays emitted from the lamp 39 downwardly through the open side 38. This reflective means takes the form of side reflectors 41, which are of a conventional type. In place of the conventional top reflector, there has been provided a faceted reflective surface 42. The surface of 42 is carried by a plate like member 43 formed of a suitable material, such as Pyrex, which is mounted in the housing 37 above the lamp 39 and which extends between the side reflectors 41. The reflective surface 42, as shown, is provided with a plurality of facets or portions 44 which are arranged to provide a Fresnel type reflector. The portions or facets 44 are planar and extend in the direction which is generally parallel to the axis of the lamp 39. The facets 44 are designed so that the light rays striking the facets are reflected from the housing 37 at relatively high angles as for example in the vicinity of 70° and higher. The light rays from the lamp 39, which impinge upon the facets 44 are identified by the lines 46 whereas the light rays reflected by the facets 44 are identified by the lines or rays 47. One of the additional advantages utilizing the Fresnel type of reflector surface within the housing 37 is that it makes it possible to decrease the depth or the height of the fixture. By way of example, the amount of reduction in the profile or height of the lighting fixture is shown by the broken line 49.

A glass enclosure 51 is provided for enclosing the open side of the housing 37. It is provided with inner and outer surfaces 52 and 53 on which there can be provided anti-reflection coatings of the type hereinbefore described.

Figure 4:
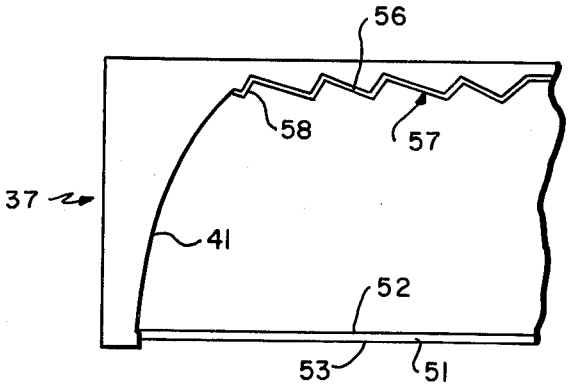
FIG. 4 is a partial cross-sectional view of the lighting fixture shown in FIG. 3 formed with a metal housing.

Another embodiment of the fixture shown in FIG. 3 is shown in FIG. 4 in which a stamped metal part 56 is provided which has the high reflecting surface 57 on the lower surface thereof. The surface of 57 is provided with a plurality of facets or portions 58, which are adapted to receive the rays from the lamp 39 in the manner hereinbefore described in conjunction with the FIG. 3 and to reflect them out of the fixture at a relatively high angle, as for example, in excess of 70°. In all other respects, the lighting fixture or luminaire 37 is similar to the one described as shown in FIG. 3. The metal which is used for the member 56 should be specular, that is, it has a high degree of direct reflection from the metal surfaces. However, if desired semispecular and semi-diffuse materials can be used which would benefit from the use of high reflecting coatings.

Figure 5:
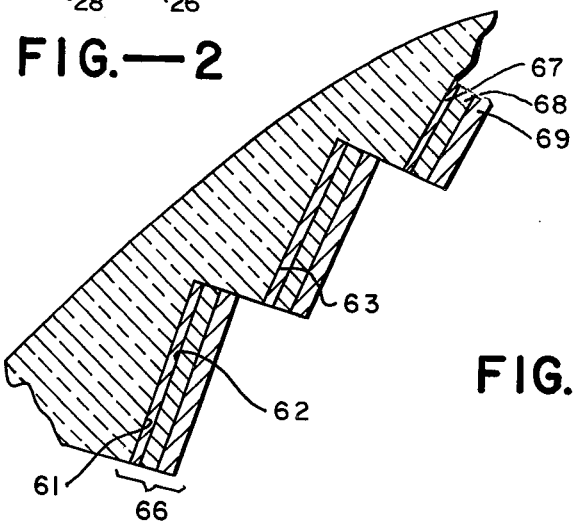
FIG. 5 is a partial cross-sectional view of a reflecting surface utilized in the embodiments of the invention shown in FIGS. 1–4 with a high reflector coating provided on the reflecting surfaces.

In FIG. 5, there is a cross-section of a faceted reflective surface formed on a glass body 62, which can form part of the housing as for example, the housing 12 as shown in FIG. 1. The surface 61 is provided with a plurality of facets or portions 63, which form a Fresnel type of reflector surface of the type hereinbefore described. Each of the facets or portions 63 has been provided with a multi-layer coating 66, which is of the high reflector type. For example, as shown in FIG. 5, such a coating can consist of a first layer 67 counting from the substrate or the glass formed of a suitable material such as aluminum. The aluminum has a suitable thickness, as for example 600 angstroms. The aluminum layer in the present invention should have a maximum reflectivity which can occur anywhere from 300 angstroms to 1000 angstroms. The reflectivity of the aluminum is approximately 90 to 91%. The second layer 68 is a protective layer formed of a suitable material such as magnesium fluoride ($MgF_2$) having an index of refraction of 1.38 and having a quarter layer optical thickness centered at the point of maximum reflectivity as for example, 500 nanometers or in the case of a sodium lamp, 589 nanometers. The top, or third layer 69 is formed of a titanium dioxide ($TiO_2$) having an index of refraction of 2.31 and a quarter wave optical thickness centered at 550 or 589 nanometers as discussed above. The two additional layers 68 and 69, will increase the reflectivity of the reflector in excess of 95% at the wavelength for which it is tuned. In addition, the two additional layers will provide a durable protective coat for the aluminum layer 67.

Two alternate three-layer high reflector coating designs can be used. Both of the coatings are aluminum for the first layer 67. In one of the additional coatings, the second layer 68 is formed of silicon dioxide ($SiO_2$) having an index of refraction of 1.45 and having a quarter wave optical thickness of 4,880 angstroms. In the second additional coating, magnesium fluoride is used for the second layer having an index of refraction of almost 1.38 and a quarter wave optical thickness of 5,880 angstroms. In the first additional coating, the third layer 69 is formed of titanium dioxide ($TiO_2$) having an index of refraction of 2.31 and a quarter wave optical thickness of 5,880 angstroms. The second additional coating had a third layer formed of zirconium oxide ($ZrO_2$) having an index refraction of 2.00 and a quarter wave optical thickness of 5,880 angstroms.

In all of the above coatings, it can be seen that aluminum has been utilized for the first layer, because it is a very practical material and it is inexpensive. There are other materials that can be utilized. However, they have disadvantages. For example, rhodium can be used, but it is expensive. Silver also can be used, but it is undesirable because it is not durable. It does not have good adhesion to glass and it will not withstand humidity testing. Aluminum is also desirable because it has a very neutral broad band of reflectivity. Other than aluminum, the other two materials used can be any combination that have a differing index. The greater the difference in the index, the greater the enhancement in the reflectivity.

In designs, where there is a relatively small differential between the indices of the two outer layers, the reflectivity can be increased by increasing the number of layers. As pointed out above, for the high index materials, zirconium dioxide and titanium dioxide are high index materials, whereas magnesium fluoride and silicon dioxide are good low index materials.

Figure 6:
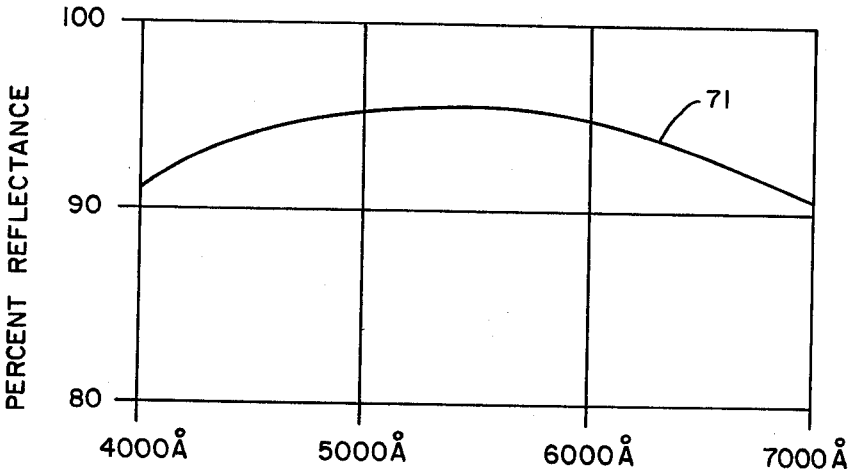
FIG. 6 is a graph showing a curve of the spectral performance of the high reflector coating shown in FIG. 5.

In FIG. 6, there is shown a graph of the reflectivity of the coating provided in the FIG. 5. As can be seen from the curve 71 in FIG. 6 the maximum reflectivity occurs at approximately 550 nanometers or 5,500 angstroms. The reflectivity at the higher and lower wavelengths is somewhat lower than at the center because the reflective surface has not been tuned to those particular wavelengths. It should be appreciated that the thickness of the layers in the coatings 66 can be modified so that the design can reflect at 95% or greater anywhere in the visual spectrum. Since the conventional or ordinary aluminum reflector of a spectral nature reflects in the vicinity of 75 to 85%, there is a 10 to 20% improvement in reflectivity by using the high reflector coating.

It is apparent from the foregoing that there has been provided a new and improved lighting fixture which has many advantages. It is possible to provide a reflector with facets or portions which will direct rays in any desired direction without depending upon the overall surface contour of the reflector. In this way it is possible to increase the coefficient of utilization of the light fixture. It also makes it possible to improve the light distribution from the light fixture or luminaire by providing more light at high angles. This lighting fixture also makes it possible for more light to leave the light fixture or luminaire at high angles directly from the lamp. The construction of the light fixture is also such that it is possible to reduce the profile of the light fixture. By increasing the size or the diameter of the fixture, it is possible to increase the number of light rays being emitted by the light fixture at high angles. By increasing the diameter of the opening in the light fixture, two advantages are obtained, one that more direct light from the lamp is obtained at high angles and two the reflected rays can be reflected at higher angles without hitting the lower edge of the housing.

What is claimed is:

1. In a lighting fixture, a housing having an open side, a lamp mounted in the housing and producing light rays passing through the open side, an internal reflecting surface carried by the housing for reflecting light rays from the lamp through the open side, said internal reflecting surface including Fresnel type portions positioned so that there is provided a Fresnel type of reflector for reflecting light rays at higher angles of 70° or greater through the open side of the housing by a single reflection of each light ray.

2. A fixture as in claim 1 together with an enclosure covering said open side, said enclosure having planar inner and outer surfaces and a high angle anti-reflection coating disposed on each of the surfaces.

3. A lighting fixture as in claim 2 wherein said reflecting surfaces are generally parabolic.

4. A fixture as in claim 2 wherein said housing is formed of glass and wherein said facets are formed in said glass.

5. A fixture as in claim 4 wherein said glass has a generally parabolic configuration.

6. A fixture as in claim 4 wherein said glass is generally a flat configuration.

7. A fixture as in claim 4 wherein together with a high reflector coating disposed on the facets.

8. A fixture as in claim 7 wherein said high reflector coating is formed of first, second and third layers counting from the surface of the facet with the first layer being formed of a metal and the second and the third layers being formed of materials having low and high indices of refraction respectively.

9. A lighting fixture as in claim 8 wherein said metal layer is formed of aluminum.

10. A lighting fixture as in claim 8 wherein said second layer is formed of a material selected from silicon dioxide and magnesium fluoride.

11. A fixture as in claim 8 wherein said third layer is formed of a material selected from titanium dioxide and zirconium dioxide.

12. A fixture as in claim 1 wherein said Fresnel type reflector surfaces are formed from metal.

* * * * *